US008985015B2

(12) United States Patent
Goetz

(10) Patent No.: US 8,985,015 B2
(45) Date of Patent: Mar. 24, 2015

(54) SCREEN-PRINTING SQUEEGEE AND APPARATUS FOR SCREEN PRINTING

(71) Applicant: THIEME GmbH & Co. KG, Teningen (DE)

(72) Inventor: Harry Goetz, Schwanau (DE)

(73) Assignee: THIEME GmbH & Co. KG, Teningen (DE)

( * ) Notice: Subject to any disclaimer, the term of this patent is extended or adjusted under 35 U.S.C. 154(b) by 0 days.

(21) Appl. No.: 13/671,359

(22) Filed: Nov. 7, 2012

(65) Prior Publication Data

US 2013/0139710 A1 Jun. 6, 2013

Related U.S. Application Data

(60) Provisional application No. 61/707,483, filed on Sep. 28, 2012.

(30) Foreign Application Priority Data

Nov. 7, 2011 (DE) ..... 20 2011 107 661 U

(51) Int. Cl.
*B41F 15/08* (2006.01)
*B41F 15/44* (2006.01)
*B41F 15/46* (2006.01)

(52) U.S. Cl.
CPC ..... *B41F 15/46* (2013.01); *B41F 15/44* (2013.01); *B41P 2215/50* (2013.01)
USPC ..... 101/123; 101/114

(58) Field of Classification Search
CPC ..... B41F 15/38; B41F 15/44; B41F 15/46; B41F 15/0872; B41F 15/0895; B41F 17/006; B41F 17/30; B41P 2215/50
USPC ..... 101/114, 123, 124, 150, 167, 169; 15/250.201, 250.202, 250.39, 250.4, 15/250.41, 250.44, 250.46–250.48, 15/250.452
See application file for complete search history.

(56) References Cited

U.S. PATENT DOCUMENTS 6,041,702 A * 3/2000 Ichikawa et al. ..... 101/35
6,834,582 B2 * 12/2004 Cutcher ..... 101/123

(Continued)

FOREIGN PATENT DOCUMENTS

DE 1 819 026 10/1960
DE 32 27 626 A1 1/1984

(Continued)

OTHER PUBLICATIONS

International Search Report dated Jun. 3, 2013 including English-language translation (Four (4) pages).

(Continued)

*Primary Examiner* — Leslie J Evanisko
*Assistant Examiner* — Marissa Ferguson Samreth
(74) *Attorney, Agent, or Firm* — Crowell & Moring LLP

(57) ABSTRACT

A screen-printing squeegee, as well as an apparatus for screen printing, includes an elastic application element and a holding apparatus for the application element. The holding apparatus is divided, as viewed over the width of the application element, into a plurality of holding sections which can move with respect to one another, in which a leaf spring element is provided. The leaf spring element interconnects the holding sections which can move with respect to one another.

11 Claims, 4 Drawing Sheets

(56) References Cited

U.S. PATENT DOCUMENTS

| | | | | |
|---|---|---|---|---|
| 7,182,019 | B2 * | 2/2007 | Cutcher et al. | 101/123 |
| 2005/0160927 | A1 | 7/2005 | Cutcher et al. | |
| 2008/0034989 | A1 | 2/2008 | Koenig et al. | |
| 2008/0202364 | A1 | 8/2008 | Mallory et al. | |
| 2008/0229944 | A1 | 9/2008 | Koenig et al. | |

FOREIGN PATENT DOCUMENTS

| | | | |
|---|---|---|---|
| DE | 295 00 856.3 | U1 | 3/1995 |
| GB | 667253 | | 2/1952 |
| WO | WO 2005/035250 | A1 | 4/2005 |
| WO | WO 2005/035251 | A1 | 4/2005 |
| WO | WO 2006/079088 | A2 | 7/2006 |

OTHER PUBLICATIONS

German-language Written Opinion (PCT/ISA/237) (Six (6) pages).

German Search Report dated Apr. 17, 2012 including partial English-language translation (Ten (10) pages).

* cited by examiner

SCREEN-PRINTING SQUEEGEE AND APPARATUS FOR SCREEN PRINTING

BACKGROUND AND SUMMARY OF THE INVENTION

The invention relates to a screen-printing squeegee having an elastic application element and a holding apparatus for the application element, the holding apparatus being divided, as viewed over the width of the application element, into a plurality of holding sections which can move with respect to one another. The invention also relates to an apparatus for screen printing having a screen-printing squeegee according to the invention.

The international laid-open specification WO 2005/035250 A1 has disclosed a screen-printing squeegee having an elastic application element in the form of a plate-shaped squeegee rubber. The plate-shaped squeegee rubber is provided with a holding apparatus, wherein impression cylinders which are also connected to a squeegee carrier act on the holding apparatus. For printing, the elastic application element is pressed by means of the impression cylinders in the direction of a printing screen and a printing table and is then moved by means of a movement of the squeegee carrier, parallel to the printing table, over the latter and/or the printing material. The division of the holding apparatus into a plurality of holding sections which can move with respect to one another is provided for the purpose of achieving a certain flexibility of the screen-printing squeegee. In order to print curved surfaces, the squeegee rubber itself is cut in accordance with the contour of the article to be printed.

The invention is intended to specify an improved screen-printing squeegee and an improved apparatus for screen printing which can be used in a flexible way for printing curved surfaces.

To this end, according to the invention, a screen-printing squeegee having an elastic application element and a holding apparatus for the application element is provided, the holding apparatus being divided, as viewed over the width of the application element, into a plurality of holding sections which can move with respect to one another, in which a leaf-spring element is provided interconnecting the holding sections which can move with respect to one another.

As a result of the provision of the leaf-spring element, the screen-printing squeegee is comparatively flexible in the plane of the application element, that is to say perpendicularly with respect to the provided printing direction, since, in this direction, the leaf spring makes a movement of the individual holding sections with respect to one another possible to a comparatively great extent. In contrast, the screen-printing squeegee is of substantially more rigid configuration in and counter to the printing direction, since the leaf-spring element makes only a very limited movement of the individual holding sections with respect to one another possible in this direction. The screen-printing squeegee is therefore of very rigid configuration in and counter to the printing direction, with the result that a precise print is made possible. As a result, curved surfaces can be printed by way of the screen-printing squeegee according to the invention, the flexible and resilient configuration of the screen-printing squeegee in the plane of the application element, that is to say perpendicularly with respect to the printing direction, making it possible to also adapt to changing curvatures and to ensure a uniform profile of the pressing force of the application element on the printing screen and the article to be printed.

The screen-printing squeegee according to the invention is also suitable for printing three-dimensionally curved surfaces, for example glass panes of bowl-like configuration for motor vehicles. The leaf-spring element is configured and arranged in such a way that a spring travel of the individual holding sections is made possible parallel to the plane of the application element, that is to say perpendicularly with respect to the provided printing direction, and a movement of the holding sections with respect to one another in and counter to the printing direction is largely suppressed. The spring action of the leaf-spring element ensures at the same time that an excessive movement of the holding sections with respect to one another is prevented and a continuous, uniform profile of the lower edge of the squeegee element is always ensured, said lower edge being decisive for the printing operation.

In one development of the invention, the leaf-spring element has a leaf spring which is contiguous, extends at least over the length of the squeegee, and from which fastening flanges extend to the individual holding sections.

By means of a contiguous leaf spring which has only one spring leaf in the embodiment which is shown, firstly the desired spring action parallel to the plane of the application element, that is to say perpendicularly with respect to the printing direction, and secondly the desired stiffening of the squeegee perpendicularly with respect to the plane of the application element, that is to say in and counter to the printing direction, can be achieved. The provision of fastening flanges makes the unproblematic arrangement of the leaf spring on the holding apparatus or the individual holding sections possible. In each case one leaf-spring element with holding flanges is advantageously provided in front of and behind the application element, as viewed in the printing direction. In this way, the leaf-spring elements themselves can be of smaller and lighter configuration, since the spring action and the stiffening of the squeegee are achieved by means of the two leaf-spring elements which are arranged in front of and behind the application element.

In one development of the invention, the leaf spring is formed from sheet-metal material and has a width which is greater than a thickness of the leaf spring, the leaf spring being oriented in such a way that the width dimension is arranged parallel to the printing direction and the thickness dimension is arranged perpendicularly with respect to the printing direction and with respect to the printing table.

An arrangement of this type of the leaf spring achieves a situation where a spring movement is possible substantially only perpendicularly with respect to the printing direction and with respect to the printing table, whereas a movement of the individual holding sections with respect to one another in and counter to the printing direction is largely suppressed.

In one development of the invention, the fastening flanges are configured integrally with the web.

In this way, a structurally simple design is achieved and the leaf-spring element can be mounted and dismantled in its entirety in a simple way.

In one development of the invention, the leaf-spring element is configured as a sheet-metal part and the fastening flanges are bent away starting from the web.

For example, the leaf-spring element can be configured in a simple way from spring steel and can be laser cut out, for example. In this case, the leaf spring consists merely of one spring leaf.

The problem on which the invention is based is also solved by an apparatus for screen printing having a screen-printing squeegee according to the invention, in which apparatus a plurality, in particular each, of the holding sections of the screen-printing squeegee are/is assigned an impression cylinder, the impression cylinders being connected firstly to the holding sections and secondly to a squeegee bar which can be moved in and counter to the printing direction, it being possible to set a pressure which loads the impression cylinders separately for at least some of the impression cylinders.

In this way, a different pressure can be set at the impression cylinders, as viewed over the width of the screen-printing squeegee, and a different contact pressure can be set in this way, as viewed over the width of the squeegee. This is of great importance if, when printing curved surfaces, a sufficient contact pressure is to be ensured even in the curvature regions.

In a screen-printing apparatus according to the invention, the impression cylinders are fastened firstly to in each case one holding section and secondly to a squeegee bar, the impression cylinders being arranged on the squeegee bar and/or on the holding sections such that they can be pivoted in each case about a pivot axis which is arranged substantially parallel to the printing direction.

In this way, the impression cylinders can be set in such a way that a force which is exerted on the application element by the impression cylinders acts substantially always perpendicularly with respect to the surface to be printed. The pivoting of the impression cylinders can take place during a setting operation, and the impression cylinders can be fixed in relation to the pivot axes after the setting operation. As an alternative, it can also be provided that the impression cylinders can also pivot about the pivot axes during the printing operation, for example when the curvature of the article to be printed changes as viewed in the printing direction.

In one development of the invention, a pivot axis is arranged approximately halfway up the squeegee bar.

In this way, a stable and geometrically favourable arrangement can be realized.

In one development of the invention, the pivot axis lies immediately above or in the region of the upper edge of the application element.

In this way, a perpendicular introduction of force, which is uniform and substantially perpendicular with respect to the pressing edge of the application element, is possible from the impression cylinders into the holding sections or the application element.

Further features and advantages of the invention result from the claims and the following description of preferred embodiments of the invention in conjunction with the drawings. Individual features which are shown in the different drawings and are described using the exemplary embodiments can be combined with one another in any desired way, without departing from the scope of the invention.

DETAILED DESCRIPTION OF THE DRAWINGS

Figure 1:
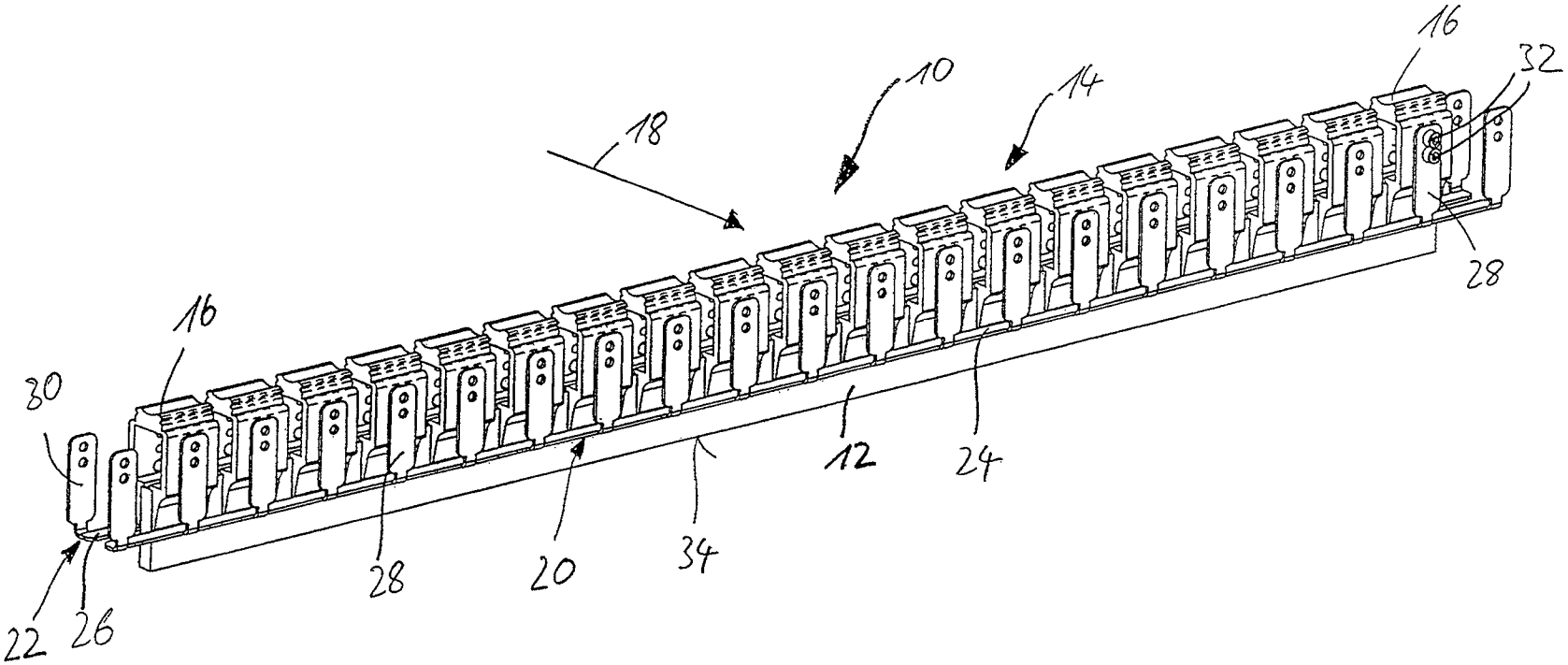
FIG. 1 shows an illustration of a screen-printing squeegee according to the invention in the partially mounted state.

The illustration of FIG. 1 shows a screen-printing squeegee 10 which has an elastic application element 12 and a holding apparatus 14 for the application element 12. The application element 12 is configured in the form of a material strip which is elastic and of rectangular cross section. The holding apparatus 14 has a plurality of clip-like holding sections 16, a total of nineteen holding sections 16 being provided as viewed over the width of the application element 12. A printing direction is denoted by means of an arrow 18. During a printing operation, the application element 12 is therefore moved over a printing screen in the printing direction 18 and, as a result, presses ink which is situated on the printing screen through openings in the printing screen onto a printing material which is arranged underneath the printing screen, for example a curved motor-vehicle pane. The width of the application element 12 lies perpendicularly with respect to the printing direction 18 and parallel to a printing table (not shown), and the length of the application element 12 lies parallel to the printing direction 18. The application element 12 therefore has a width which is substantially greater than its length.

The holding sections 16 are in each case of clip-like configuration and engage over an upper edge of the elastic application element 12. However, the individual holding sections 16 are configured as holding clips which are separate from one another, with the result that the individual holding sections 16 can be moved relative to one another.

The holding sections 16 are connected both on a front side of the screen-printing squeegee 10 and on a rear side of the screen-printing squeegee 10 to in each case one leaf-spring element 20, 22. The leaf-spring elements 20, 22 are connected to the holding clips of the holding sections 16 above the application element 12.

The two leaf-spring elements 20, 21 are configured in each case integrally as a sheet-metal flexible part and in each case have a leaf spring 24, 26 and a plurality of fastening flanges 28, 30 which are bent away from the leaf spring 24. Each of the holding sections 16 is assigned in each case one fastening flange 28, 30, and the fastening flanges 28 are fastened in each case by means of two threaded bolts 32 to the holding sections 16 which are configured as holding clips.

As can be seen in FIG. 1, a width of the leaf spring 24 is greater than a thickness of the leaf spring 24. Here, the thickness direction runs perpendicularly with respect to the printing direction 18 and with respect to a printing table (not shown), and the width direction runs parallel to the printing direction 18. The leaf spring 24 is therefore configured in the form of a single spring leaf and makes a spring movement possible substantially only perpendicularly with respect to the printing direction 18 and perpendicularly with respect to a printing table (not shown), that is to say in the thickness direction of the spring leaf in FIG. 1 and therefore from bottom to top and vice versa. In and counter to the printing direction 18, the leaf spring is substantially stiffer on account of its considerably greater width in comparison with the thickness, and therefore largely prevents a movement of the individual holding sections 16 in and counter to the printing direction 18. The width of the leaf spring 24 is approximately from five to ten times greater than the thickness of the leaf spring 24, it being possible for the ratio of width to thickness and the spring stiffness of the leaf spring to be adapted to the provided application. A plurality of spring leaves can also optionally be provided which are of different length, in order to achieve the desired spring action.

During a printing operation, the individual holding sections 16 can therefore move relative to one another perpendicularly with respect to the printing direction 18 and perpendicularly with respect to the printing table, and in this way the elastic application element 12 can be deformed in such a way that its pressing edge 34 runs in a curved manner thus adapting itself to the contour of an article to be printed. Nevertheless, yielding of the application element 12 and specifically of the pressing edge in and counter to the printing direction 18 is largely avoided, since a movement of the individual holding sections among one another in and counter to the printing direction 18 is largely prevented by the two leaf springs 24, 26.

The screen-printing squeegee according to the invention is therefore very flexible perpendicularly with respect to the printing direction 18 and perpendicularly with respect to the printing table and can adapt itself to curvatures of an article to be printed. In contrast, the screen-printing squeegee 10 is very stiff in and counter to the printing direction and, as a result, makes a very precise printing operation possible.

Figure 2:
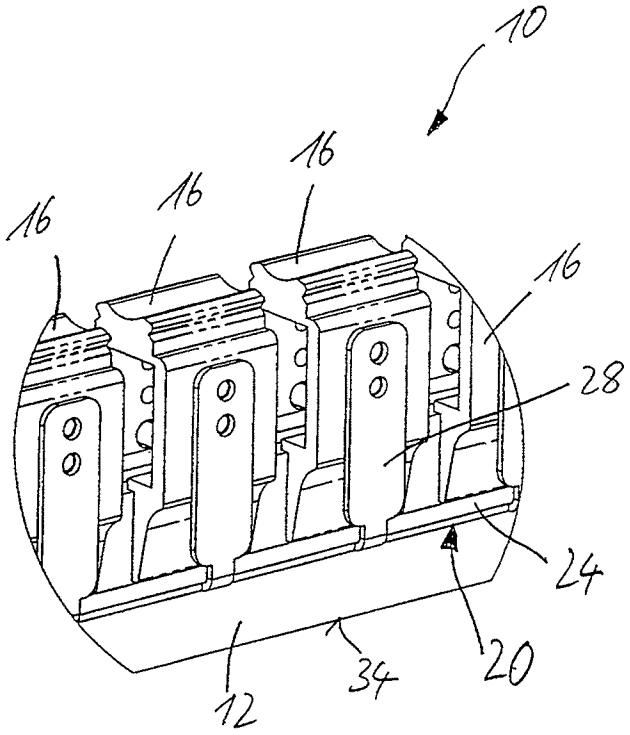
FIG. 2 shows an enlarged illustration of a section of the screen-printing squeegee from FIG. 1.

In the illustration of FIG. 2, an enlarged illustration of a section of the screen-printing squeegee 10 can be seen. Merely two of the holding sections 16 are shown completely and two further holding sections 16 are shown partially. As has already been explained using FIG. 1, the holding sections 16 are configured in each case as holding clips and engage around the upper edge of the elastic application element 12. The limbs of the said holding clips can be moved towards one another for a clamping operation, in order to clamp the elastic application element 12 reliably.

The leaf-spring element 20 has the leaf spring 24, starting from which the fastening flanges 28 extend. The fastening flanges 28 are then fastened in each case to the limbs of the holding clips of the holding sections 16, the fastening of the fastening flanges 28 taking place by means of the threaded bolts 32 to the holding sections 16 above an upper edge of the elastic application element 12. In contrast, the leaf spring 24 is arranged approximately halfway up the application element 12 and approximately at the level of the free end of the limbs of the holding clips of the holding sections 16.

Figure 4:
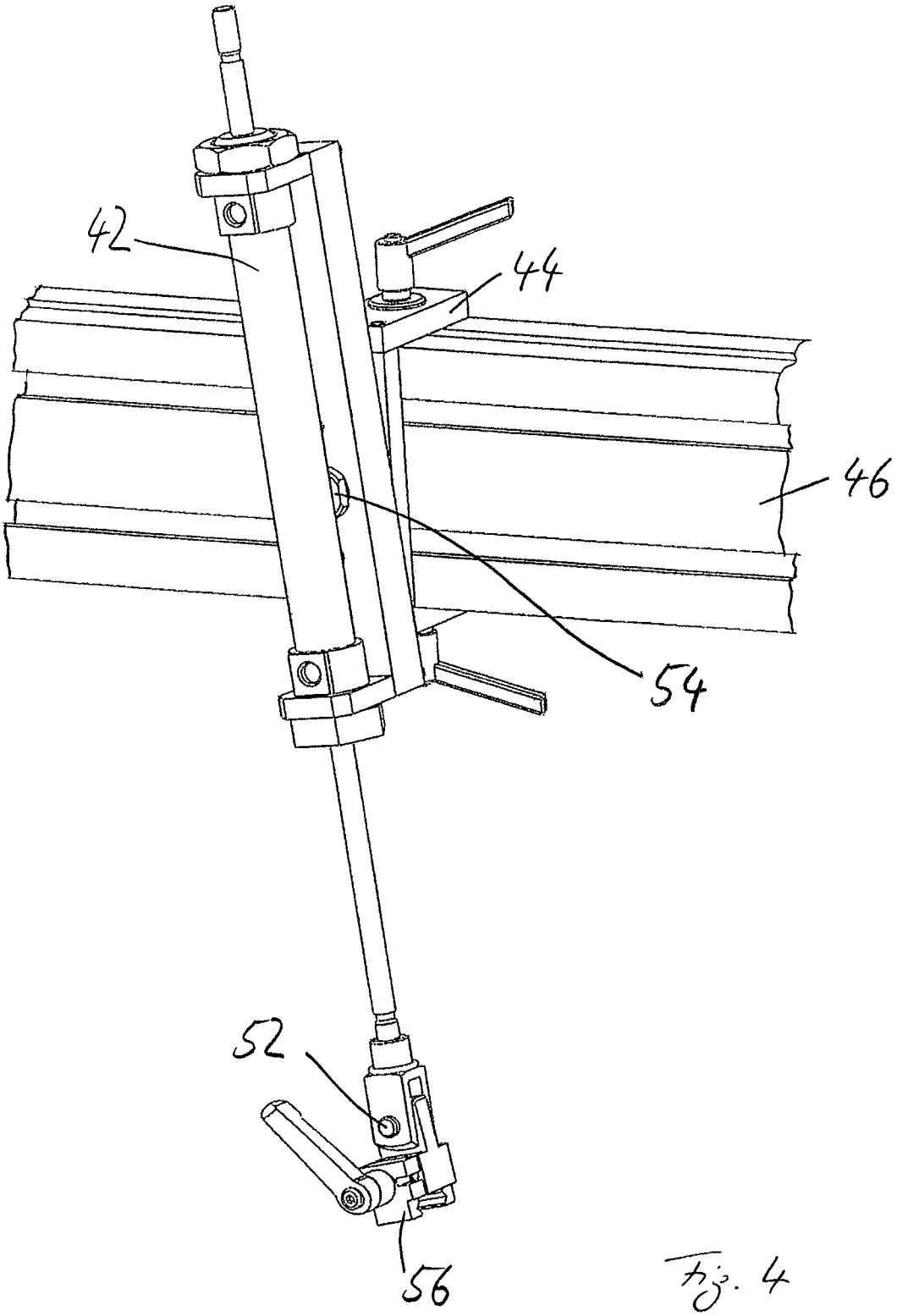
FIG. 4 shows a section of the screen-printing apparatus from FIG. 3.

The holding sections 16 are profiled in the form of holding grooves at their upper end which faces away from the application element 12, with the result that they can be clamped into clamping jaws 56 of a squeegee receptacle, see FIG. 4.

Figure 3:
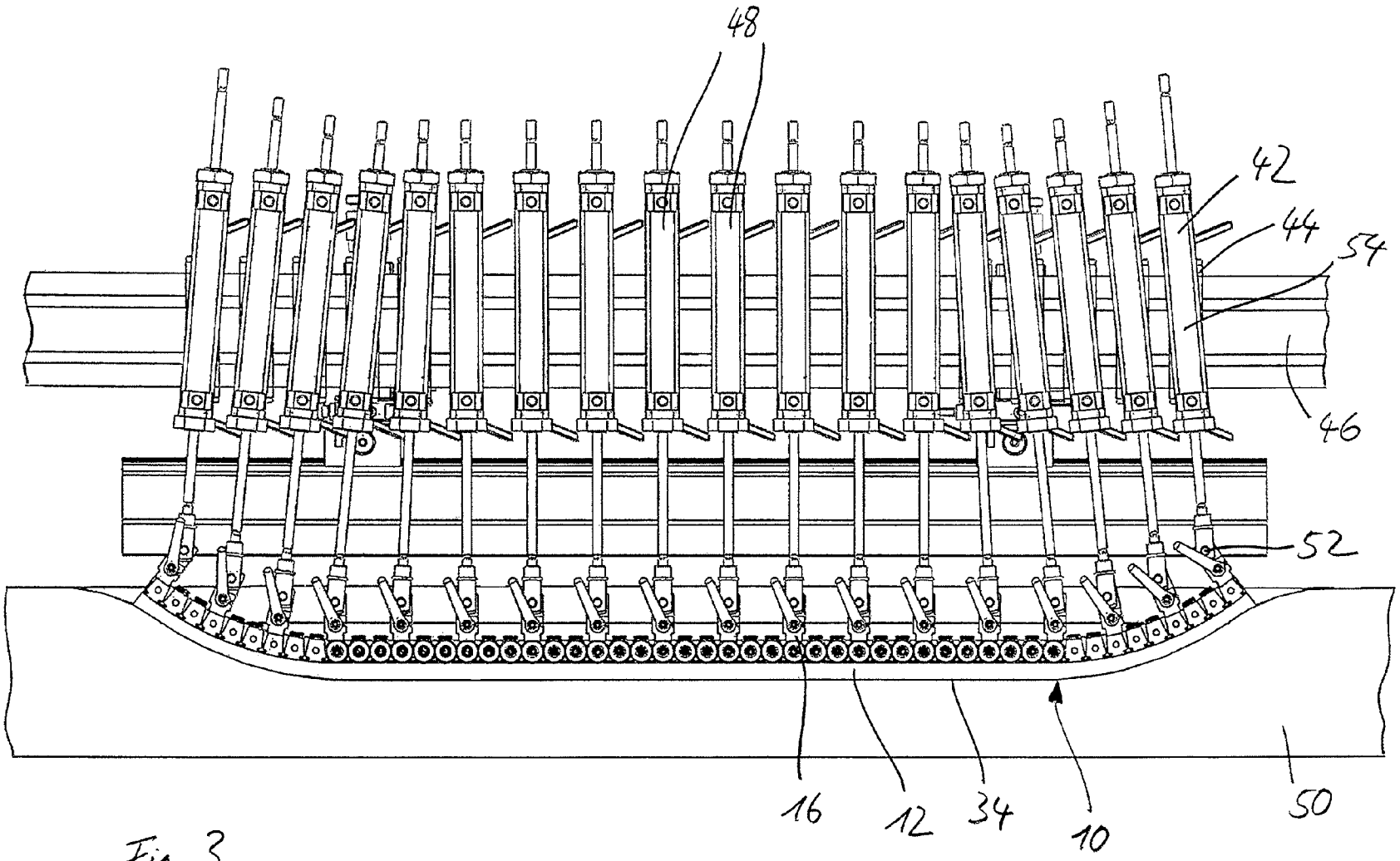
FIG. 3 shows a partial illustration of a screen-printing apparatus according to the invention.

The illustration of FIG. 3 shows a screen-printing apparatus 40 according to the invention with a screen-printing squeegee 10 according to the invention, from the front, that is to say counter to the printing direction 18 in FIG. 1. The leaf-spring element of the screen-printing squeegee 10 is of slightly different configuration than in the embodiment of FIG. 1, but the illustration of FIG. 3 serves substantially to clarify the construction of the screen-printing apparatus 40 according to the invention.

Each of the holding sections 16 is assigned in each case one impression cylinder 42, 48. The impression cylinders 42, 48 are arranged firstly on the holding sections 16 and secondly on receiving elements 44, the receiving elements 44 being arranged displaceably on a squeegee bar 46.

As can be seen in the illustration of FIG. 3, the impression cylinders 42 are deflected partially out of their perpendicular position with respect to the squeegee bar 46. With the exception of the two central impression cylinders 48, the impression cylinders 42 are arranged such that they can be pivoted about a respective pivot axis 52, 54 both relative to the application element 12 on the squeegee bar 46 and relative to the holding sections 16. The pivot axes 52, 54 all run parallel to the printing direction 18, that is to say perpendicularly with respect to the plane of the drawing in FIG. 3. As can be seen in FIG. 3, an introduction of force can take place by means of the impression cylinders 42, as a result, over the entire width of the screen-printing squeegee 10, approximately perpendicularly with respect to its pressing edge 34 which, during a printing operation, rests on a printing screen (not shown) which in turn rests on a printing material to be printed (not shown) which in turn lies on a printing table 50. It can be seen in the region of the left-hand and right-hand end of the screen-printing squeegee 10 that the introduction of pressure does not take place exactly perpendicularly with respect to the pressing edge 34. An improvement is possible here as a result of the fact that the position of the pivot axis 52 is moved further in the direction of the pressing edge 34. The pivot axis 52, with which the impression cylinders 42 are arranged pivotably on the holding sections 16, is advantageously arranged in the region of the upper edge of the elastic application element 12 or even below the upper edge of the application element 12.

The squeegee angle can be set in a manner which is not shown, that is to say an angle between the application element 12 and the surface to be printed. This is realized by a curved slotted guide on the squeegee receptacle between the pivot axis 52 and the clamping jaws 56.

The illustration of FIG. 4 shows one of the impression cylinders 42, the screen-printing squeegee 10 not being shown in FIG. 4. It can be seen that a pivot axis 52, about which the impression cylinder 42 can be pivoted relative to the receiving element 44, is arranged halfway up the squeegee bar 46. The receiving element 44 is provided with two clamping screws and can be displaced along the squeegee bar 46. The movement about the pivot axis 54 and about the pivot axis 52 can be blocked, with the result that, in a setting operation, the impression cylinders 42 are pivoted about the pivot axes 52, 54 and are then blocked. As an alternative, the pivoting of the impression cylinders 42 about the pivot axes 52, 54 can be made possible even during a printing operation, in order to make an adaptation of the screen-printing squeegee 10 possible to changing curvatures of the article 50 to be printed. This is advantageous, for example, when the article 50 to be printed is a bowl-like car pane, the curvature of which perpendicularly with respect to the printing direction and also in and counter to the printing direction changes over its length.

A squeegee receptacle with clamping jaws 56 and with a clamping screw is provided at the lower end of the impression cylinder 42, in each case the holding sections 16 (see FIG. 1 and FIG. 2) then being clamped by way of the clamping jaws 56. As a result, the screen-printing squeegee 10 is configured such that it can be mounted and dismantled in a simple way.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A Screen-printing squeegee comprising:

an elastic application element; and a holding apparatus for the application element, wherein the holding apparatus is divided, as viewed over a width of the application element, into a plurality of holding sections which can move with respect to one another, two leaf-spring elements are provided interconnecting the holding sections which can move with respect to one another, and the first leaf spring element is arranged on a front side of the screen printing squeegee and the second leaf spring element is arranged on a rear side of the screen printing squeegee.

2. The screen-printing squeegee according to claim 1, wherein at least one of the two leaf-spring elements have a leaf spring which is continuous, extends at least over the width of the application element, and from which fastening flanges extend to the individual holding sections.

3. The screen-printing squeegee according to claim 1, wherein the leaf spring is formed from sheet-metal material, a thickness of the leaf spring perpendicularly with respect a printing direction being smaller than a width of the spring leaf parallel to the printing direction, with the result that a spring movement of the leaf spring is made possible substantially only perpendicularly with respect to the printing direction and perpendicularly with respect to a printing table.

4. The screen-printing squeegee according to claim 1, wherein fastening flanges are configured integrally with the leaf spring.

5. The screen-printing squeegee according to claim 4, wherein the leaf-spring element is configured as a sheet-metal part and the fastening flanges are bent away starting from the leaf spring.

6. A screen-printing apparatus having a screen-printing squeegee according to claim 1, wherein each holding section is assigned an impression cylinder, it being possible to set a pressure which loads the impression cylinders independently of one another for at least some of the plurality of impression cylinders.

7. The screen-printing apparatus, according to claim 6, with a screen-printing squeegee having an elastic application element and a holding apparatus for the application element, the holding apparatus being divided, as viewed over the width of the application element, into a plurality of holding sections which can move with respect to one another, wherein the impression cylinders are fastened firstly to in each case one holding section and secondly to a squeegee bar, the impression cylinders being arranged at least partially on the squeegee bar and the respective holding section such that they can be pivoted about a pivot axis which is arranged parallel to a printing direction.

8. The screen-printing apparatus according to claim 7, wherein the pivot axis is arranged approximately halfway up the squeegee bar.

9. The screen-printing apparatus according to claim 8, wherein the pivot axis is arranged immediately above or in a region of an upper edge of the elastic application element.

10. The screen-printing apparatus according to claim 7, wherein the pivot axis is arranged immediately above or in a region of an upper edge of the elastic application element.

11. The screen-printing apparatus according to claim 1, wherein the leaf spring is formed from sheet-metal material, a thickness of the leaf spring perpendicularly with respect to a printing direction being smaller than a width of the leaf spring parallel to the printing direction, with a result that a spring movement of the leaf spring is made possible substantially only perpendicularly with respect to the printing direction and perpendicularly with respect to a printing table.

* * * * *